US007255544B2

(12) United States Patent
Dong et al.

(10) Patent No.: US 7,255,544 B2
(45) Date of Patent: Aug. 14, 2007

(54) HOUSING INCLUDING SHOCK VALVES FOR USE IN A GEROTOR MOTOR

(75) Inventors: Xingen Dong, Greeneville, TN (US); Barun Acharya, Johnson City, TN (US)

(73) Assignee: Parker-Hannifin, Cleveland, OH (US)

( * ) Notice: Subject to any disclaimer, the term of this patent is extended or adjusted under 35 U.S.C. 154(b) by 150 days.

(21) Appl. No.: 10/972,171

(22) Filed: Oct. 22, 2004

(65) Prior Publication Data

US 2005/0088041 A1 Apr. 28, 2005

Related U.S. Application Data

(60) Provisional application No. 60/513,828, filed on Oct. 23, 2003.

(51) Int. Cl.
*F03C 2/00* (2006.01)
*F03C 4/00* (2006.01)
*F04C 2/00* (2006.01)

(52) U.S. Cl. ..... 418/61.3; 417/391; 417/440

(58) Field of Classification Search ..... 418/61.3, 418/104, 166, 170, 171; 417/391, 405, 440
See application file for complete search history.

(56) References Cited

U.S. PATENT DOCUMENTS 1,621,495 A 3/1927 Conradson
1,886,205 A 11/1932 Lyfod
2,607,295 A 8/1952 Drucker
2,875,779 A 3/1959 Campbell
3,286,645 A * 11/1966 Albers ..... 418/61.3
3,712,758 A * 1/1973 Lech et al. ..... 417/214
3,880,554 A * 4/1975 Termansen et al. ..... 418/61.3
4,199,305 A * 4/1980 Pareja ..... 417/440
4,443,161 A 4/1984 Masuda et al.
4,519,755 A * 5/1985 Hanson ..... 418/171
5,630,399 A 5/1997 Nomura et al.
5,782,615 A 7/1998 Noah et al.
6,095,765 A 8/2000 Khalifa
6,162,024 A * 12/2000 Bruzek ..... 417/222.1
6,382,593 B1 5/2002 deCler et al.
6,513,546 B2 2/2003 Katsura
6,783,339 B2 * 8/2004 Dong et al. ..... 418/61.3
2002/0100507 A1 8/2002 Hauser et al.

* cited by examiner

*Primary Examiner*—Theresa Trieu
(74) *Attorney, Agent, or Firm*—Joseph J. Pophal; Daniel J Whitman; Robert J. Clark

(57) ABSTRACT

A housing for a motor having fluid passages integrated within. The passages include a first passage for receiving a fluid from outside the motor, a second passage for directing the fluid away from the motor, and at least one other passage from conveying the fluid to a set of components attached to the motor housing. The housing has at least one relief valve positioned within the fluid passages for diverting a portion of the fluid directly from the first passage to the second passage.

11 Claims, 13 Drawing Sheets

HOUSING INCLUDING SHOCK VALVES FOR USE IN A GEROTOR MOTOR

CROSS-REFERENCE TO RELATED CASES

The present application claims the benefit of the filing date of U.S. Provisional Application Ser. No. 60/513,828; filed Oct. 23, 2003, the disclosure of which is expressly incorporated herein by reference.

FIELD OF THE INVENTION

The present invention relates to a motor for a hydrostatic transition. More particularly, the present invention relates to a housing for the motor and the incorporation of relief valves into the housing for diverting high pressure fluid away from the motor componentry.

BACKGROUND OF THE INVENTION

Riding lawn mowers and similar vehicles are generally driven by hydrostatic transmissions. Specifically, such vehicles use dual path hydraulic transmissions. Each transmission consists of an over-center variable displacement pump and a fixed displacement motor. The input shaft of the pump is coupled with an internal combustion engine and the output shaft of the motor is coupled with a vehicle wheel. Changing the flow rate and direction of the pump flow will cause the change of rotation speed and the direction of rotation of the wheel.

Any shock load, e.g. in the form of an impediment to the rotation of the wheels, can impart a shock load to the entire hydraulic transmission. This shock load, typically in the form of excessive pressure, can deleteriously affect the components to the system. Many prior art designs of hydraulic transmissions do not integrate parts, e.g. relief valves, into the system in order to protect these components.

Some prior art system designs that have incorporated relief valves into the hydraulic transmission have positioned the valve within the pump. This type of design will protect the pump from shock loads but will not protect the other components, e.g. the motor, that first experience the shock. Specifically, if the shaft of the motor experiences any sudden resistance, or load, a surge of pressure initially will travel through the motor, possibly causing damage. The pressure spike may also damage all other componentry between the motor and pump prior to being dissipated within the pump.

Other prior art designs utilize a stand alone component, e.g. an end cover, attached to the motor to house the relief valves. The attachment of the end cover, with relief valves, will dissipate these pressure surges. However the end cover, with incorporated relief valves, adds an unwanted length to the motor. The present invention overcomes the above obstacles by incorporating the relief valves directly in the housing of the motor.

SUMMARY OF THE PRESENT INVENTION

The present invention provides a housing for a motor having fluid passages integrated within. The passages include a first passage for receiving a fluid from outside the motor, a second passage for directing the fluid away from the motor, and at least one other passage from conveying the fluid to a set of components attached to the motor housing. The housing has at least one relief valve positioned within the fluid passages for diverting a portion of the fluid directly from the first passage to the second passage.

A further feature of the noted housing is that it houses a two-pressure zone gerotor motor. Another feature of the noted housing is that the set of components include a gerotor set and a shaft positioned within the housing. Still a further feature of the noted housing has the at least one relief valve being a first relief valve which opens when the pressure within the first passage is greater than a predetermined amount and a second relief valve which opens with the pressure within the second passage is greater than a predetermined amount. Still another feature of the noted housing has both of the first and second relief valves having a poppet and a spring made of one piece.

Another attribute of the present invention includes having a housing for a motor where the housing has fluid passages integrated within. The passages include a first passage for receiving fluid from outside the motor, a second passage for directing fluid away from the motor and at least one other passage for conveying fluid to a set of components attached to the motor housing. The housing contains at least one relief valve in fluid communication with the first and second passages for directing a portion of fluid from the first passage to the second passage without fluidly communicating with the at least one other passage. A further attribute of the noted housing has the at least one other passage receiving a shaft.

Still another attribute of the noted housing has the at least one relief valve including a first relief valve positioned within a first bore in fluid communication with the first passage and a second relief valve positioned within a second bore in fluid communication with the second passage. A further attribute of the noted housing is the housing is for a two-pressure zone gerotor motor. Another attribute has the at least one valve including a first valve positioned within a bore in fluid communication with the first passage. Still another attribute has the at least one valve including a valve positioned within a bore in fluid communication with the second passage.

Still a further feature of the present invention includes a hydrostatic transmission having a motor and a pump wherein the motor has a housing with an attached shaft and an attached gerotor set. The housing incorporates at least one pressure relief valve for directing a portion of a fluid from a first passage directly to a second passage.

Another feature of the present invention includes a hydrostatic transmission having a motor and a pump wherein the motor has a housing with an attached shaft and an attached gerotor set. The housing incorporates at least one pressure relief valve for directing a portion of a fluid received from a first passage away from the gerotor set.

Still yet another attribute of the present invention includes a fixed displacement motor for a hydrostatic transmission. The motor has a housing with a first port, a second port, a first longitudinal end and a second longitudinal end. The motor has a shaft, received within the housing, with a first end extending through the housing first longitudinal end. The motor has a wear plate adjacently affixed to the housing and a gerotor set adjacently affixed to the wear plate. The motor further has a manifold adjacently affixed to the gerotor set, a commutator assembly adjacently affixed to the manifold, and an end cap adjacently affixed to the commutator assembly. The housing has a first relief valve positioned within a first bore in fluid communication with the first port and a second relief valve positioned within a second bore in fluid communication with the second port. The first valve opens when hydraulic pressure within the first port reaches a predetermined amount and directs hydraulic fluid from the first port to the second port bypassing the gerotor set. The second valve opens when hydraulic pressure within the second port reaches a predetermined amount and directs hydraulic fluid from the second port directly to the first port bypassing the gerotor set.

Further features of the present invention will become apparent to those skilled in the art upon reviewing the following specification and attached drawings.

DETAILED DESCRIPTION OF THE PREFERRED EMBODIMENT

Hydrostatic transmissions commonly are used with riding lawn mowers and similar vehicles. Such vehicles can be propelled by dual path hydraulic transmissions. Each transmission consists of an over-center variable displacement pump and a fixed displacement motor. The input shaft of the pump is coupled with an internal combustion engine and the output shaft of the motor is coupled with a vehicle wheel. A change in the flow rate and direction of the pump fluid flow will cause a change of rotation speed and direction of rotation of the vehicle wheel. When the movement of the vehicle wheel is impeded, a load is transferred to the motor shaft. When the shaft of the motor initially experiences this load (or resistance), excessive pressure (in the form of pressure spikes) is sensed within the motor and throughout the system. As is well known in the art, excessive pressure can damage not only the first component that experiences the spike but also other componentry within the system. Therefore systems incorporate shock valves that prevent the spikes from reaching the componentry that can be damaged.

Figure 16:
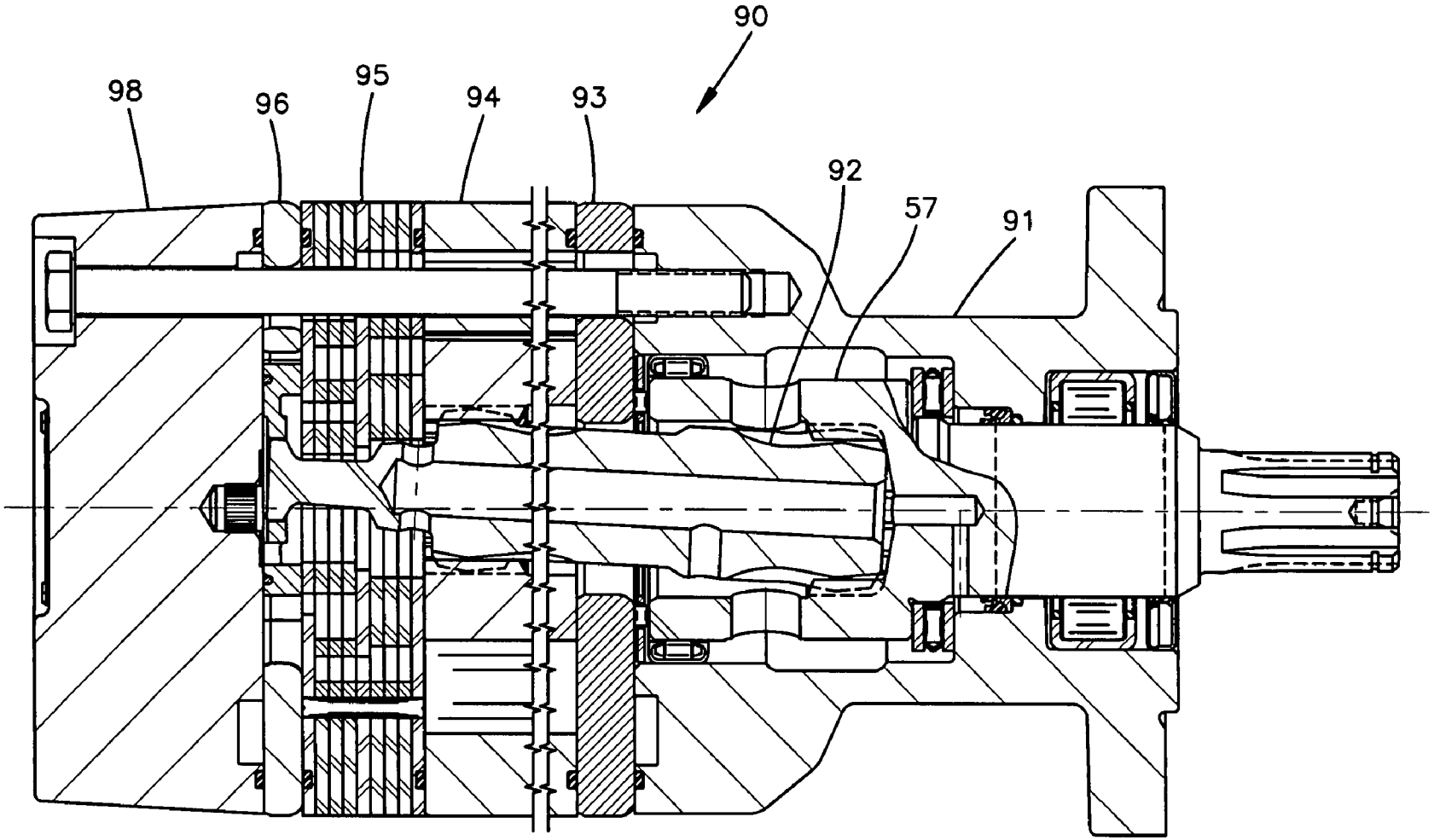
Fig.16 PRIOR ART
FIG. 16 is a longitudinal, cross-sectional view of a prior art motor.

FIG. 16 exhibits a prior art fixed displacement motor 90. Motor 90 has a housing 91, a coupling shaft 57, a wear plate 93, a drive link 92, a rotor assembly 94, a manifold 95, a commutator assembly 96 and an end cap 98. Motor 90 does not include pressure relief valves which, as noted above, are designed to open in order to relieve excessive pressure when the transmission is subjected to a shock load. The relief valve could be integrated into the pump, or motor, or could be a stand-alone unit in the closed-loop circuit.

Figure 1:
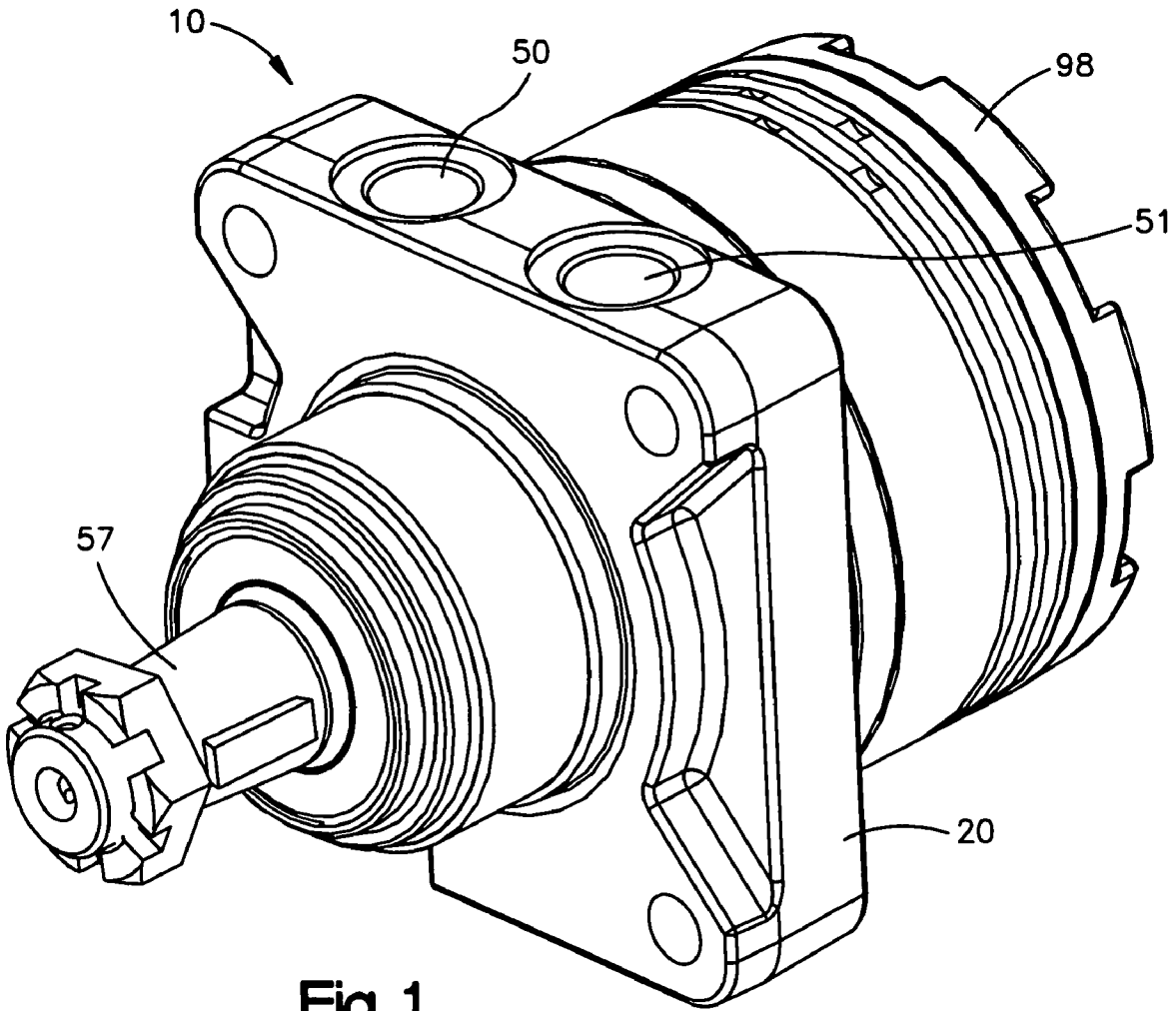
FIG. 1 is an elevated view of a motor utilizing a housing according to the present invention.
Figure 2:
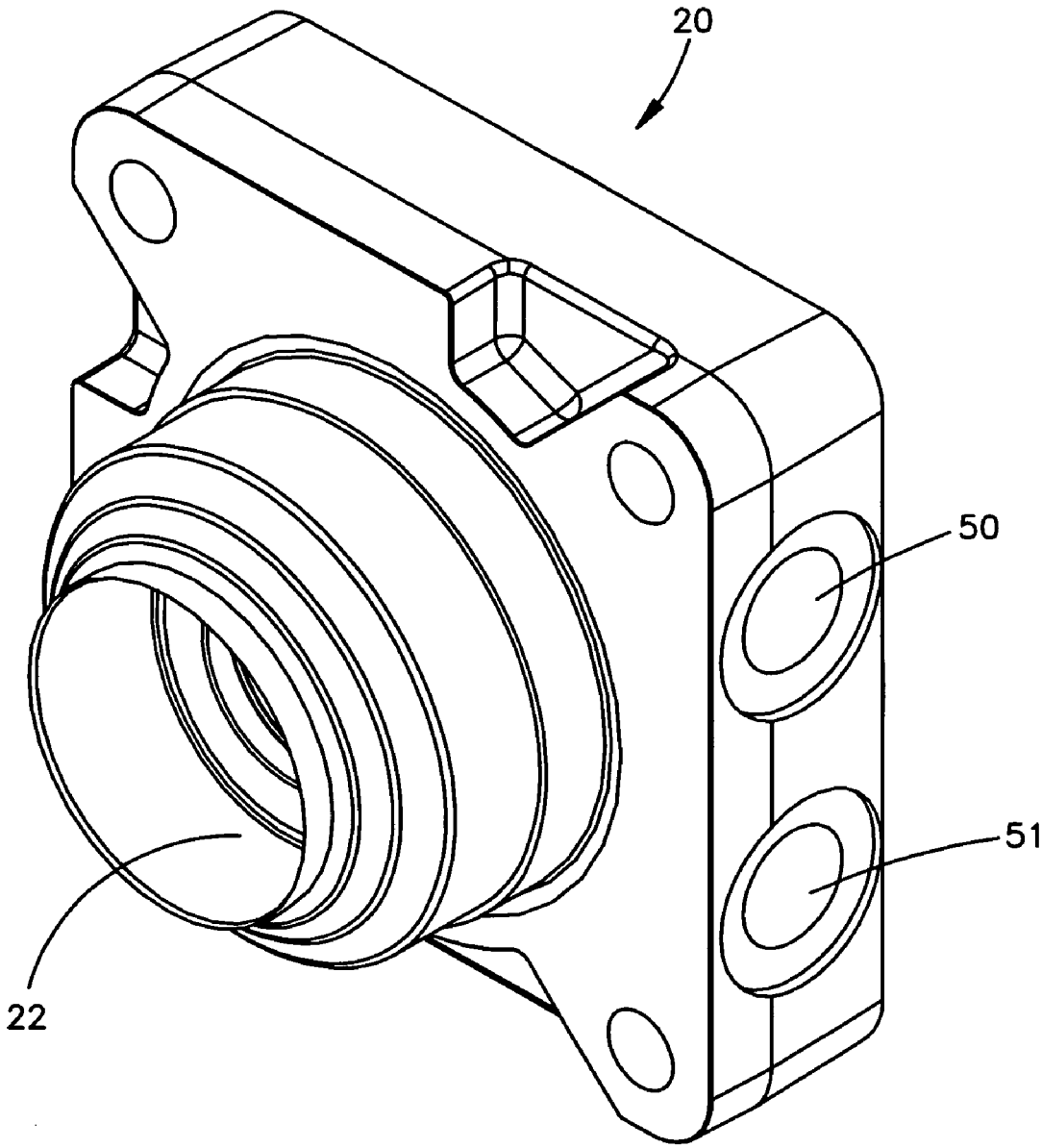
FIG. 2 is an elevated view of the housing shown in FIG. 1.
Figure 3:
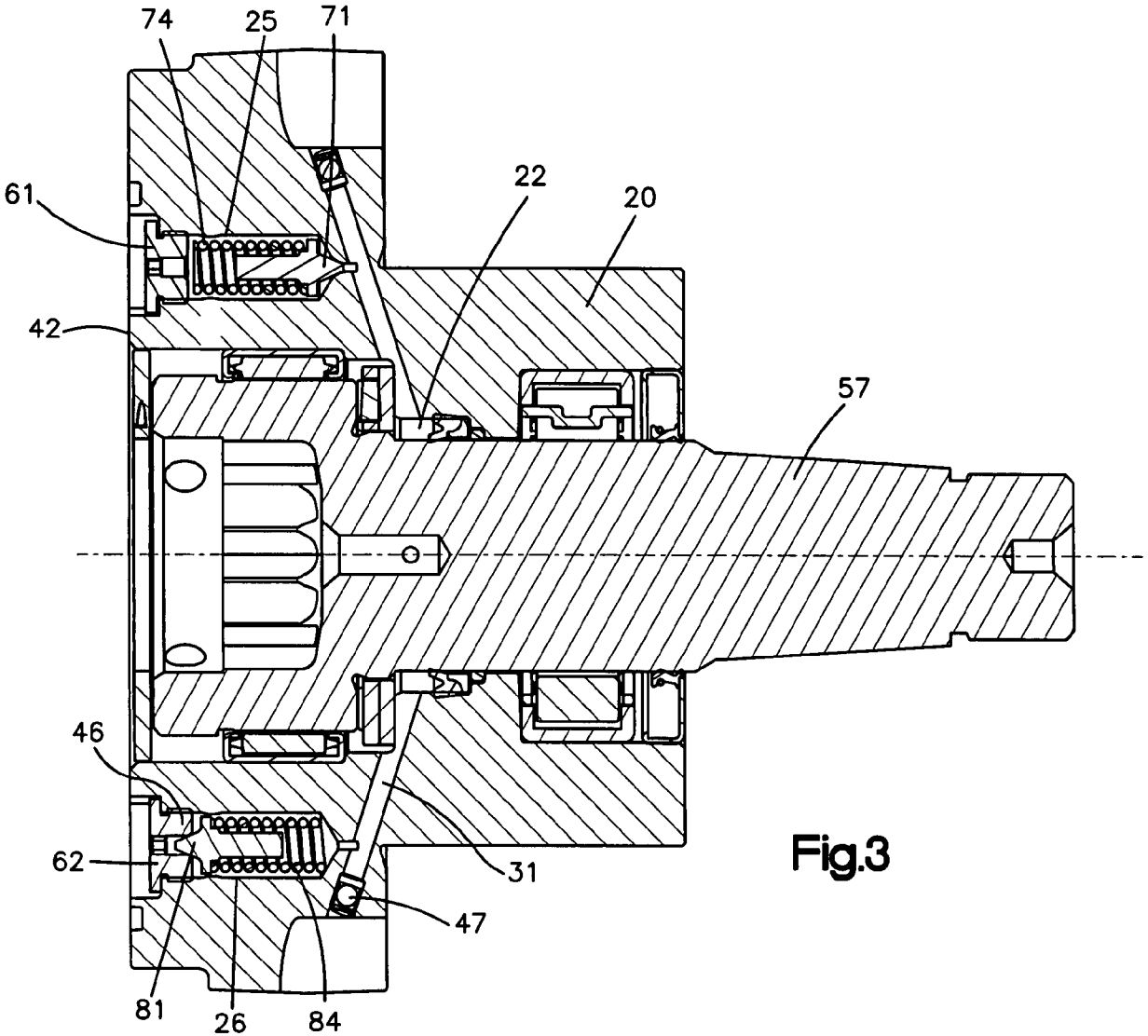
FIG. 3 is a longitudinal, cross-sectional view of the motor shown in FIG. 1.
Figure 5:
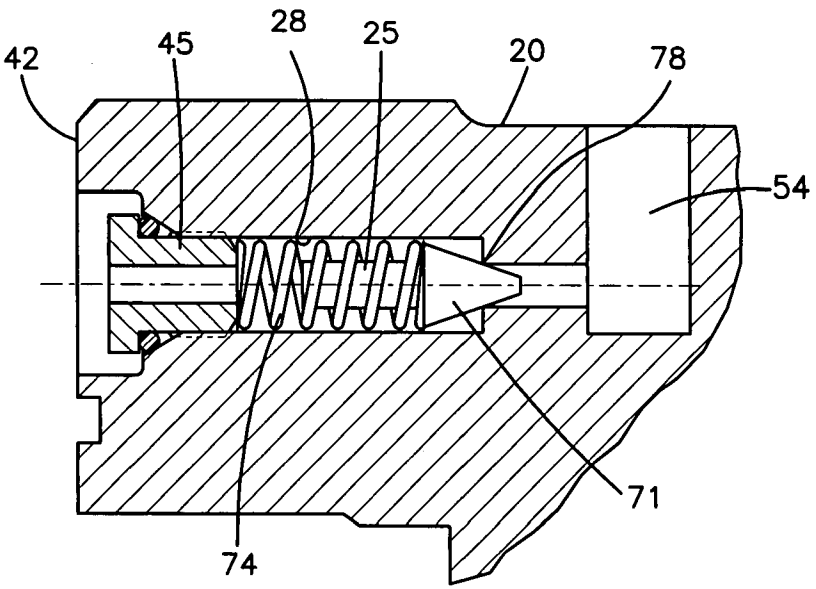
FIG. 5 is a cross-sectional cutaway of a valve, similar to that shown in FIG. 4, housed within the motor shown in FIG. 3.
Figure 4:
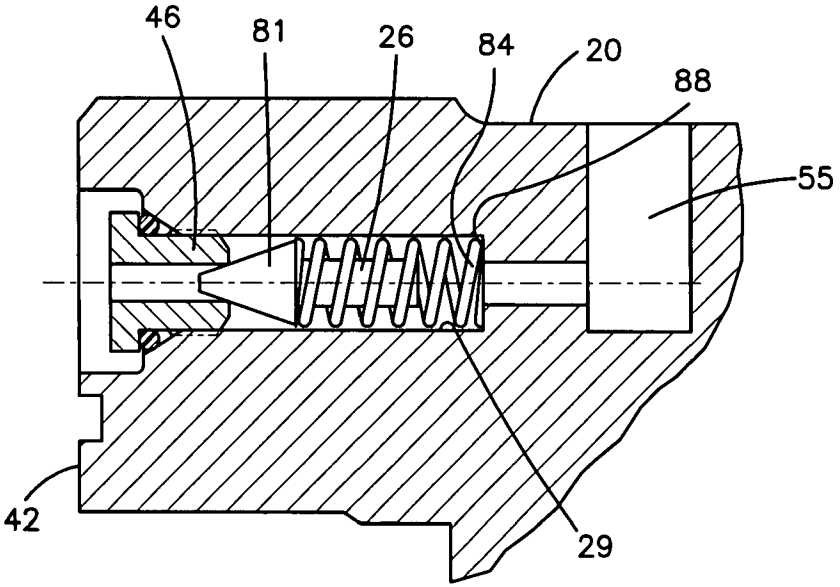
FIG. 4 is a cross-sectional cutaway of a valve housed within the motor shown in FIG. 3.
Figure 6:
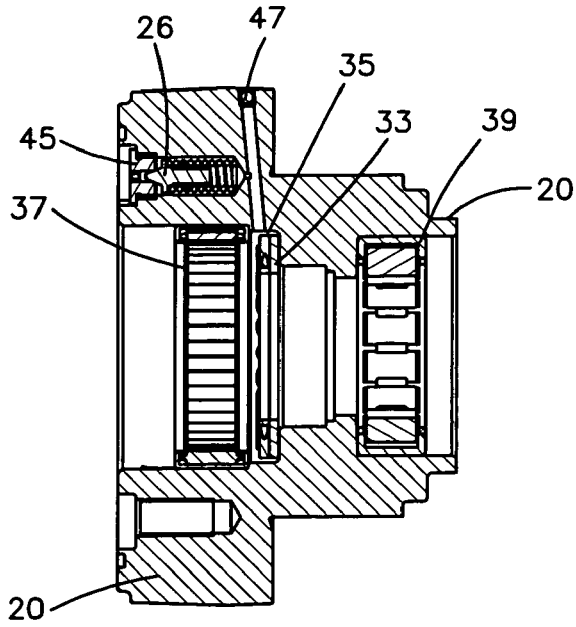
FIG. 6 is a longitudinal, cross-sectional view of the motor housing taken along the lines 6-6 of FIG. 7.
Figure 12:
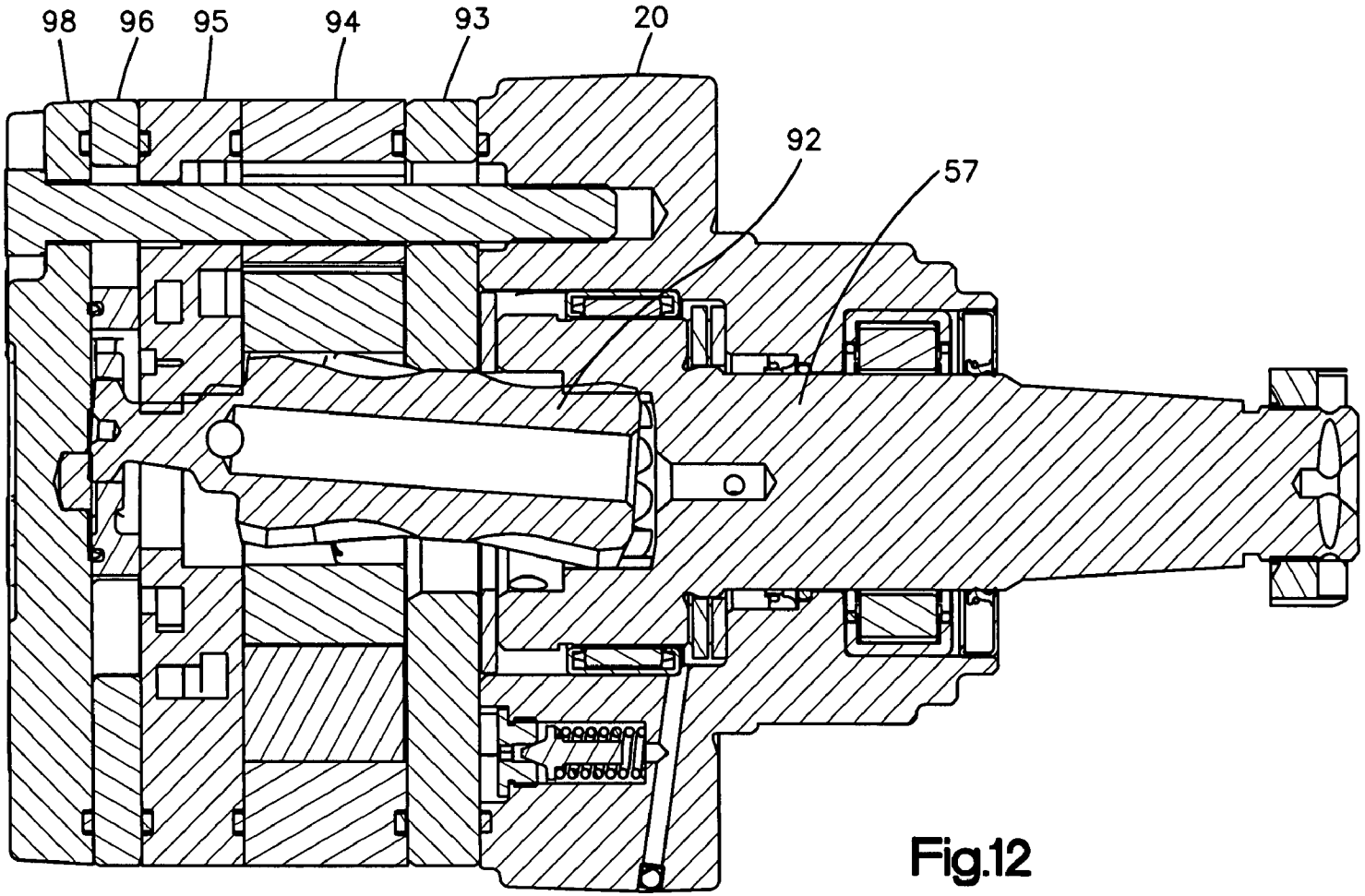
FIG. 12 is a longitudinal, cross-sectional view of the motor taken along the lines 12-12 in FIG. 10.

Referring to FIGS. 1-6, a motor 10 according to the present invention is shown. Motor 10 has a housing 20 including a pair of relief, or shock valves 25, 26 for a two-pressure zone gerotor motor. Shock valve 25 has a front end, or poppet, 71 and a spring 74. Poppet 71 can be a unitary piece with spring 74, as shown in FIG. 3 or a separate piece, as is shown in FIG. 5. Likewise, shock valve 26 has a front end, or poppet, 81 and a spring 84. Poppet 81 can be unitary with spring 84, as is shown in FIG. 3 or a separate piece, as is shown in FIG. 4. It should be noted that although FIG. 3 shows valves 25, 26 at 180° apart, this is for demonstration purposes only. It should also be noted that the components that attach to prior art housing 91 (in FIG. 16) also are attached to housing 20, as shown in FIG. 12, and have the same element numbers as used in FIG. 16. Specifically, wear plate 93, rotor assembly 94, manifold 95, commutator assembly 96 and end cap 98 would be attached to housing 20 in the same fashion as shown in FIG. 16. FIG. 3 only shows motor housing 20 in order to highlight the inclusion of valves 25, 26. Also shown (in FIG. 6) within motor housing 20 is a thrust washer 33, a thrust bearing 35, an inboard bearing 37, an outboard bearing 39, a plug 45 and another plug 47. It should also further be noted that although shock valves 25, 26 are shown integrated into the housing for a two-pressure zone motor, valves 25, 26 could also be integrated into the housing of any motor for a hydrostatic transmission.

Figure 9:
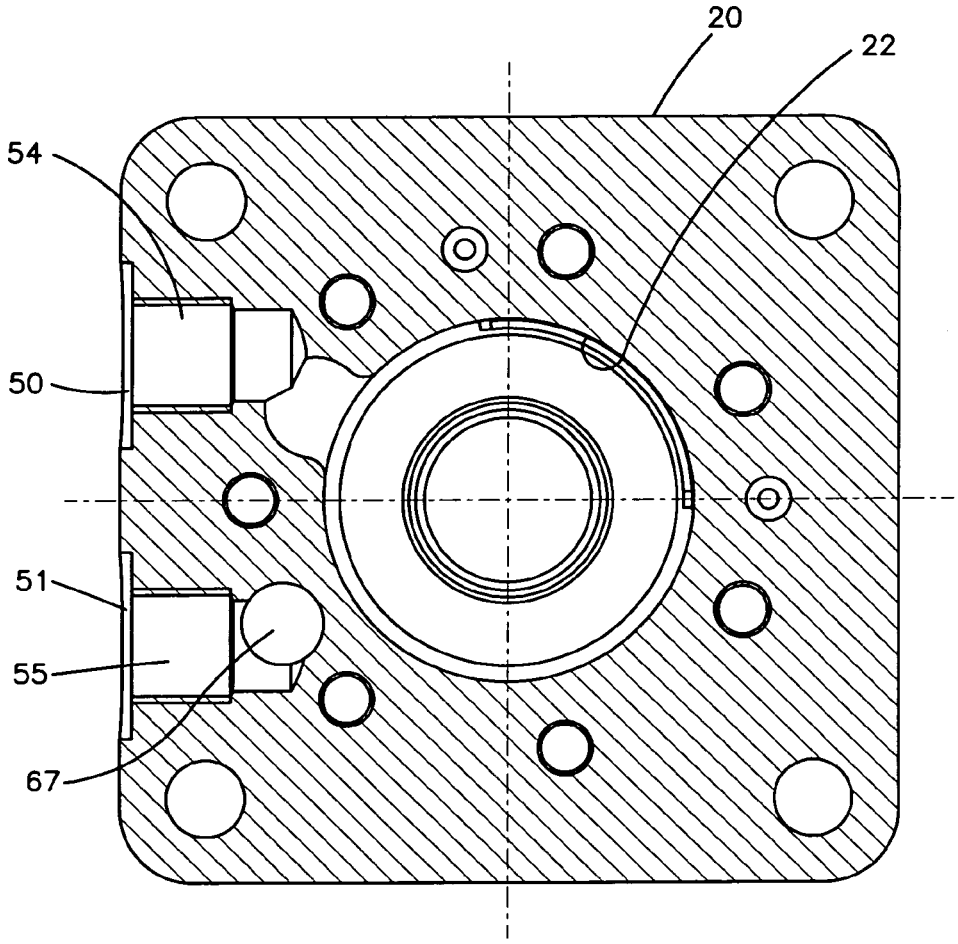
FIG. 9 is a radial, cross-sectional view of the motor housing shown in FIG. 2.
Figure 10:
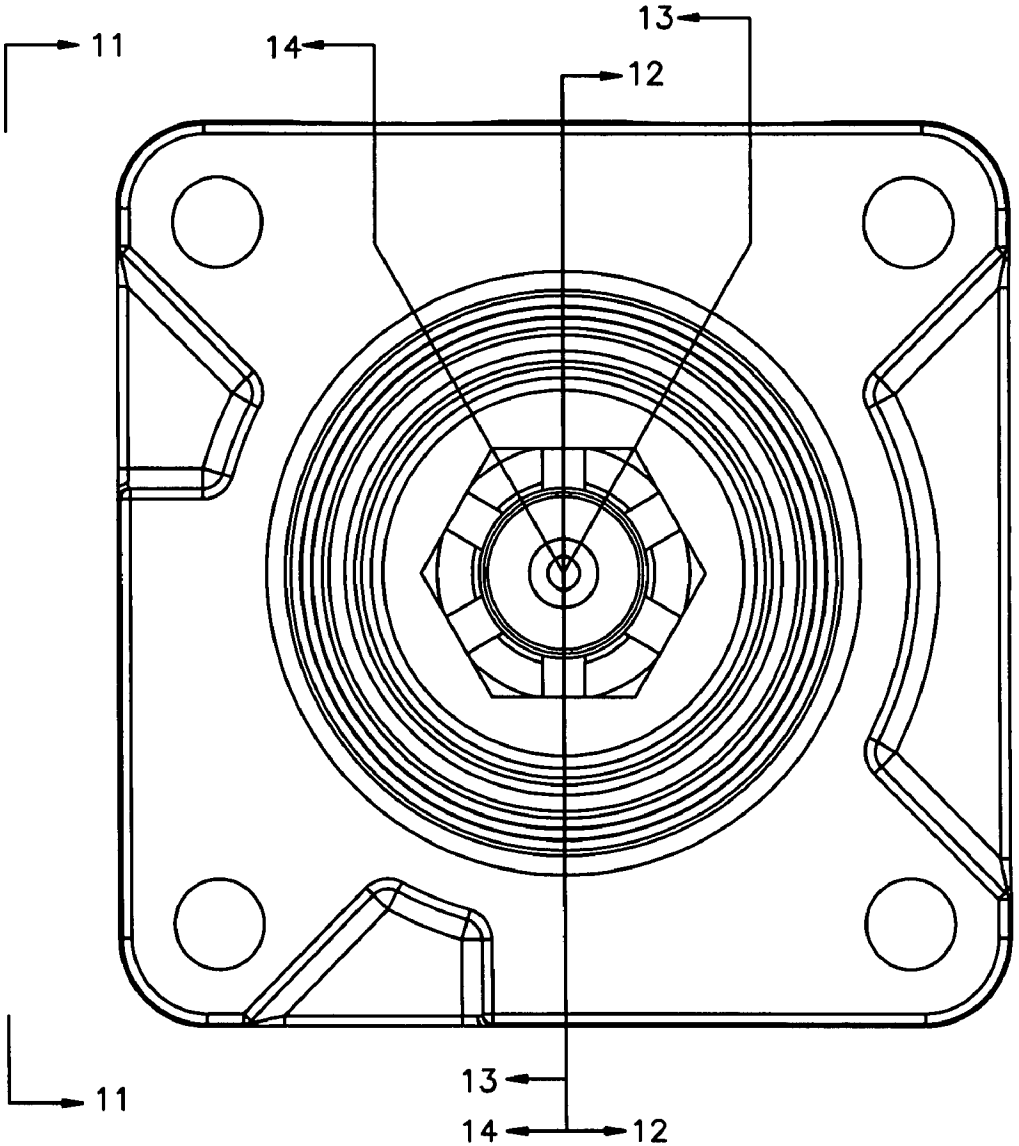
FIG. 10 is a frontal view of the motor shown in FIG. 1.
Figure 11:
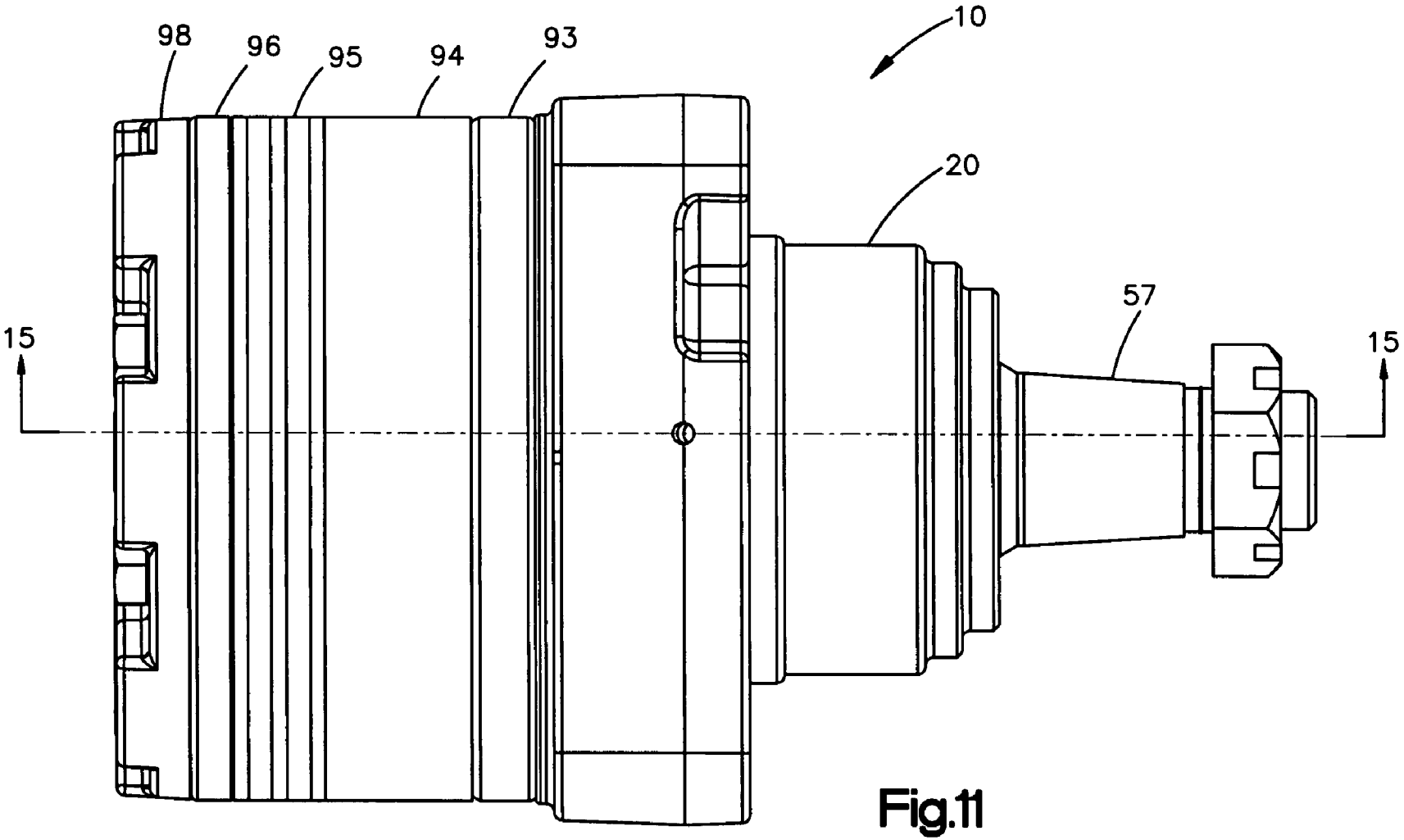
FIG. 11 is a side view of the motor taken along the lines 11-11 in FIG. 10.
Figure 13:
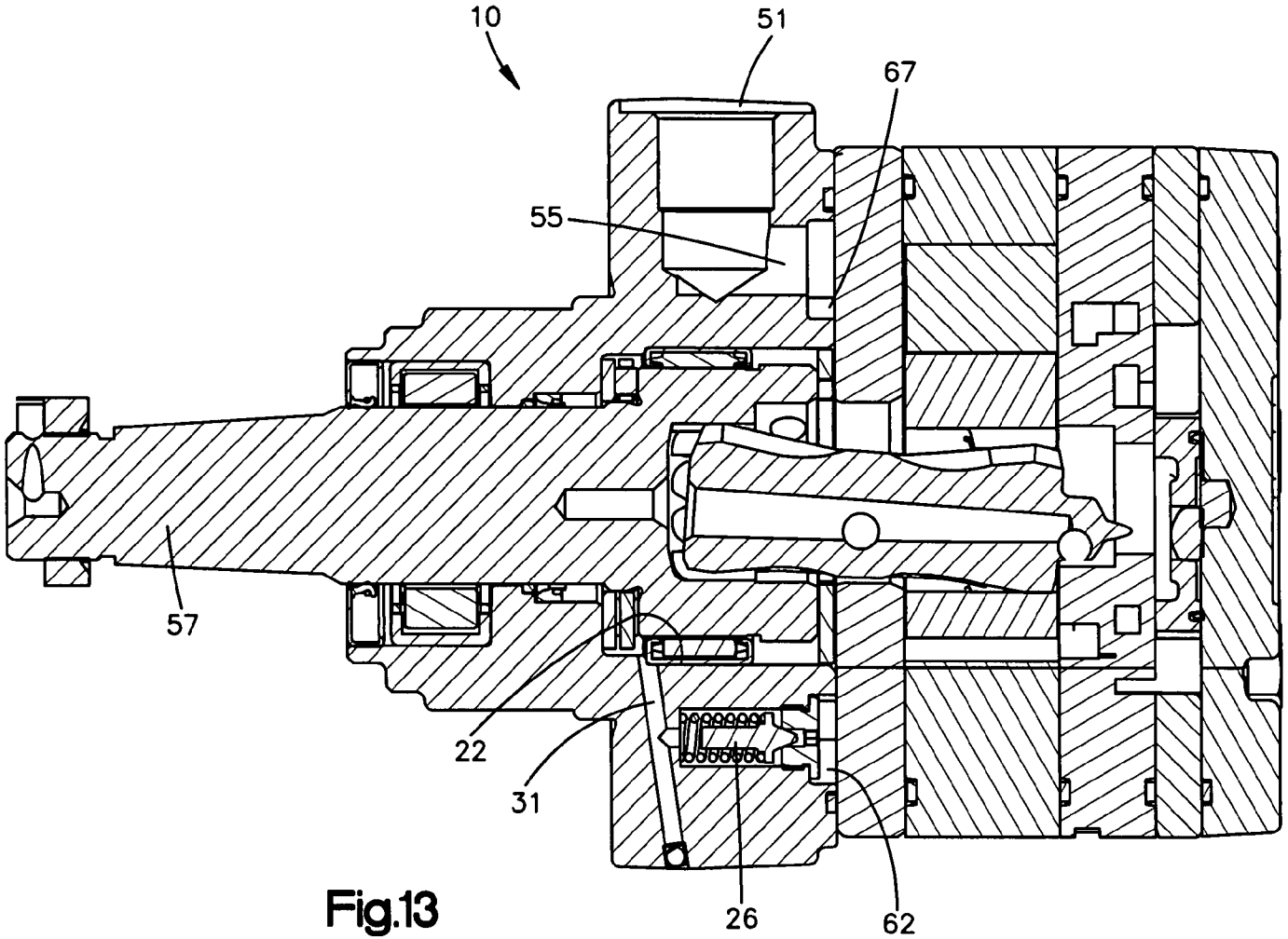
FIG. 13 is a longitudinal, cross-sectional view of the motor taken along the lines 13-13 in FIG. 10.
Figure 14:
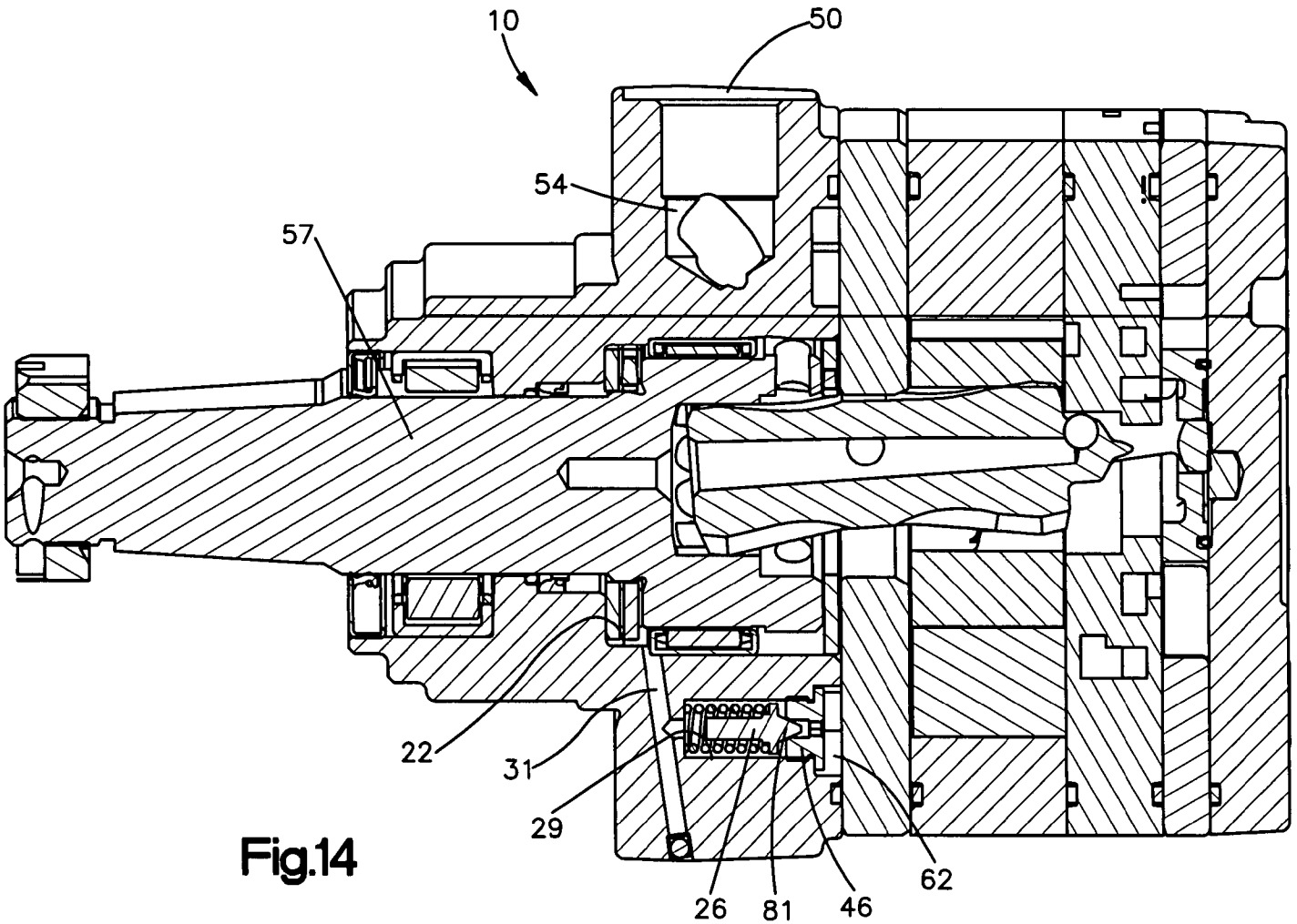
FIG. 14 is a longitudinal, cross-sectional view of the motor taken along the lines 14-14 in FIG. 10.
Figure 15:
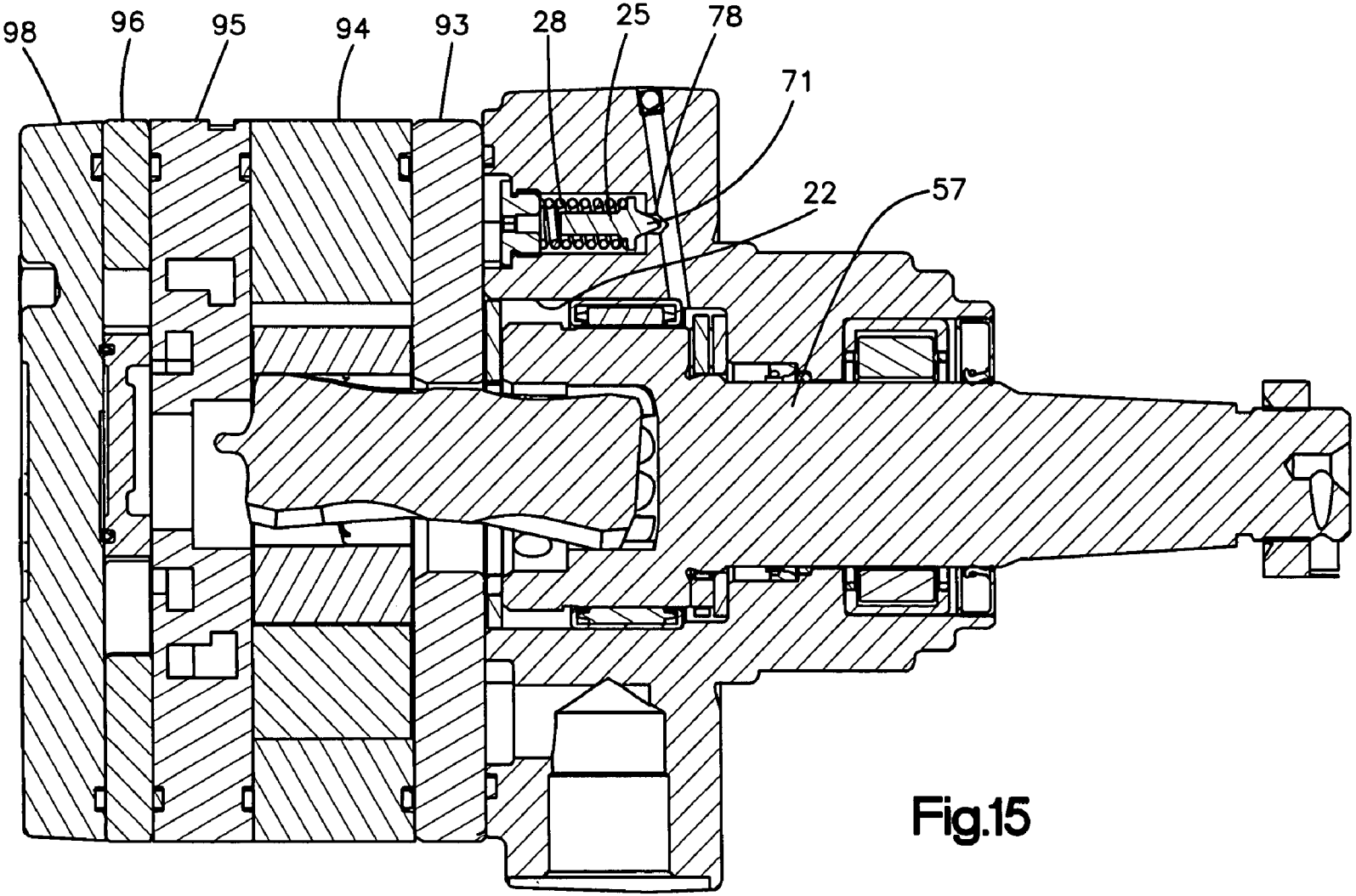
FIG. 15 is a longitudinal, cross-sectional view of the motor taken along the lines 15-15 in FIG. 11.

Referring to FIGS. 4 and 5, both valves 25, 26 rest within passages contained by housing 20. Valve 25 is housed within a first passage 28 extending from a fluid channel 54 (best shown in FIGS. 9 and 14) to an end face 42 of housing 20. Valve 25 front end 71 is biased (e.g. by spring 74) towards a shoulder 78 of first passage 28. The rear end of valve 25 (or spring 74) is contained by plug 45. In its resting position, front end 71 is in sealing contact with shoulder 78. Valve 26 is housed within a second passage 29 extending from the end face 42 of housing 20 to a second fluid channel 55 (best shown in FIGS. 9 and 13). Valve 26 front end 81 is biased (e.g. by spring 84) towards a plug 46. The rear end of valve 26 (or spring 84) is in contact with a shoulder 88 of passage 29. In its resting position, front end 81 is in sealing contact with plug 46. It should be noted that both valves 25, 26 are entirely housed, or contained, within housing 20 and do not extend outside housing 20. Although the positioning of valves 25, 26 are evident in FIGS. 12-15, they are not shown in the sectional view of FIG. 9. However both valves 25, 26 are positioned out of the view shown in FIG. 9 (or at the viewer) with valve 25 being directed from channel 54.

Figure 7:
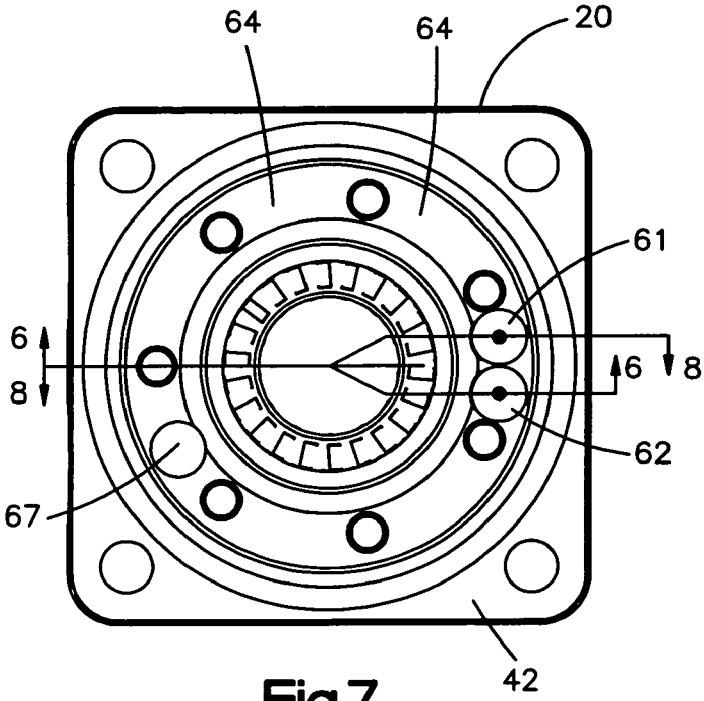
FIG. 7 is a frontal view of the motor housing shown in FIG. 2 taken from its end face.
Figure 8:
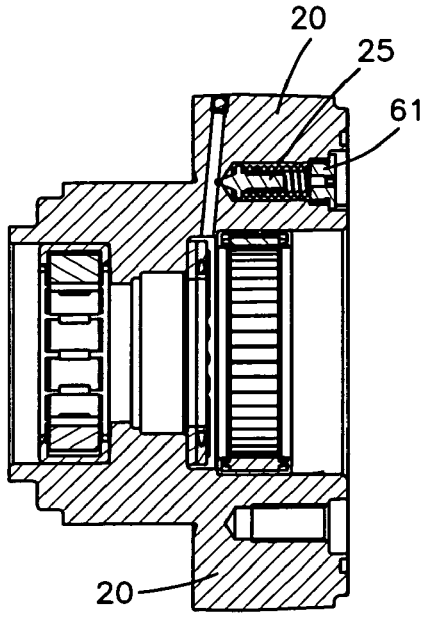
FIG. 8 is a longitudinal, cross-sectional view of the motor housing, similar to that shown in FIG. 6, taken along the lines 8-8 of FIG. 7.

In order to demonstrate the function of shock valves 25, 26, the flow of pressurized fluid through housing 20 will be explained. Referring to FIGS. 1, 3, 7, 9 and 15, pressurized hydraulic fluid is received from the pump, not shown, into a first port 50. If the pressure of the fluid is not greater than the cracking pressure of valve 25, the fluid will travel through fluid channel 54 straight to the middle of housing 20 and enter a bore 22. Fluid will travel along bore 22, on the outside of shaft 57 (towards the left in FIGS. 3 and 15 and towards the viewer in FIG. 9) and enters rotor assembly 94, manifold 95, and commutator assembly 96 and rotates shaft 57 a first direction, for example clockwise, as is well known in the art. If the pressure of the fluid is greater than the cracking pressure of valve 25, valve 25 will open when poppet 71 moves off of shoulder 78. A portion of the fluid will pass through passage 28, out of an opening 61, and into an annular recess 64 (as best shown in FIG. 7) located at end face 42 of housing 20. The fluid will enter an orifice 67, travel through a second fluid channel 55 and out a second port 51, which provides an exit for the fluid. The end face of housing 20, shown in FIG. 7, abuts wear plate 93 which has passages leading the fluid to rotor assembly 94, manifold 95 and commutator assembly 96. When this portion of the fluid enters orifice 67, it bypasses rotor assembly 94, manifold 95 and commutator assembly 96.

The fluid pressure within the motor will be reduced during the diversion of a portion of the fluid past valve 25 through passage 28. When the fluid pressure is reduced to less than the cracking pressure of valve 25, the entire fluid flow is directed towards housing bore 22 in order to turn shaft 57. By diverting a portion of the high pressurized fluid away from bore 22, damage to componentry of motor is avoided.

In order to reverse the rotation of shaft 57, for counter-clockwise rotation, hydraulic fluid from the pump is now reversed. Referring to FIGS. 1, 3, 7, 9, 13 and 14, pressurized fluid is received within motor 10 through port 51 and travels through fluid channel 55 and out orifice 67. Pressurized fluid fills annular recess 64 and is also present within an opening 62. This fluid also travels through wear plate 93, rotor assembly 94, manifold 95 and commutator assembly 96. If the pressure of this fluid is less than the cracking pressure of valve 26 (which is in fluid communication with opening 62), the fluid will not be able to pass valve 26 and will travel through the other components (e.g. rotor assembly 94), thus turning shaft 57, before exiting motor 10 through fluid channel 54 and out port 50. This movement of fluid is typical for the rotational operation of motor 10. If the fluid pressure within motor 10 is greater than the cracking pressure of valve 26, valve 26 will open when poppet 81 moves off of plug 46, thus allowing fluid to pass through passage 29. Fluid will then travel through a slanted passage 31 towards housing bore 22, through fluid channel 54 and out of housing 20 through port 50. This ensures that the fluid pressure within motor 10 will be reduced during the diversion of fluid past valve 26 through passage 29. When the fluid pressure is reduced to less than the cracking pressure of valve 26, the entire fluid flow is directed towards the motor components in order to turn shaft 57. By diverting a portion of the high pressurized fluid away from these components, damage to motor 10 is avoided.

Since the inlet and outlet of each shock valve 25, 26 is linked to both sides of the transmission, flow will bypass motor 10 when either shock valve 25, 26 is opened under excessive load. The design of motor housing 20 has cavities for at least one shock valve. More specifically, if the forward direction is the predominant use for the motor, then only one shock valve would be necessary. Likewise, if the reverse direction is the predominant use for the motor, then only one shock valve would be necessary. If both directions, i.e. forward and reverse, are being utilized then the motor housing design would incorporate two shock valves for both directions. Due to the unique two-pressure zone design of motor 10, the outlet of each valve 25, 26 is always linked to the low-pressure side of the motor. Thus, a percentage of flow bypasses motor 10 when it is under a shock load and prevents damage to the motor from these pressure surges. Thus, it will extend the endurance life of the whole transmission. As also can be seen from the above description, the present invention does not utilize a separate component (as prior art designs do) for housing shock/relief valves. Rather valves 25, 26 are housed entirely within housing 20, thus minimizing the size of motor 10.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fixed displacement motor for a hydrostatic transmission having:

a housing with a first port and a second port, having a first longitudinal end and a second longitudinal end;

a shaft received within said housing having a first end extending through said housing first longitudinal end;

a wear plate adjacently affixed to said housing;

a gerotor set adjacently affixed to said wear plate;

a manifold adjacently affixed to said gerotor set;

a commutator assembly adjacently affixed to said manifold;

an end cap adjacently affixed to said commutator assembly;

wherein said housing has a first relief valve positioned within a first bore in fluid communication with said first port and a second relief valve positioned within a second bore in fluid communication with said second port, said first valve opens when hydraulic pressure within said first port reaches a predetermined amount and directs hydraulic fluid from said first port to said second port, bypassing said gerotor set, said second valve opens when hydraulic pressure within said second port reaches a predetermined amount and directs hydraulic fluid from said second port directly to said first port, bypassing said gerotor set.

2. A housing for a motor having fluid passages integrated within, including a first passage for receiving a fluid from outside of said motor, a second passage for directing said fluid away from said motor and at least one other passage for conveying said fluid to a set of components attached to said motor housing, wherein said housing has at least one pressure relief valve positioned within said fluid passages, said at least one pressure relief valve being biased into a closed position and opening in response to an excessive pressure condition for diverting a portion of said fluid from said first passage to said second passage, wherein said at least one relief valve is a first relief valve which moves from a first position to a second position and is in said second position when the pressure within said first passage is greater than a predetermined amount and a second relief valve which moves from a first position to a second position and is in said second position when the pressure within said second passage is greater than a predetermined amount.

3. The housing as in claim 2 wherein said motor is a two-pressure zone gerotor motor.

4. The housing as in claim 2 wherein said set of components include a gerotor set and a shaft positioned within said housing.

5. The housing as in claim 2 wherein both of said first and second relief valves have a poppet and a spring made of one piece.

6. The housing as in claim 2 wherein said portion of said fluid is high pressure fluid.

7. A housing for a motor having fluid passages integrated within, including a first passage for receiving fluid from outside of said motor, a second passage for directing fluid away from said motor and at least one other passage for conveying fluid to a set of components attached to said motor housing, wherein said housing contains at least one pressure relief valve in fluid communication with said first and second passages, said at least one pressure relief valve being biased into a closed position and opening in response to an excessive pressure condition for directing a portion of fluid from said first passage to said second passage without fluidly communicating with said at least one other passage, wherein said at least one relief valve includes a first relief valve positioned within a first bore in fluid communication with said first passage and a second relief valve positioned within a second bore in fluid communication with said second passage, wherein said first passage, said second passage and said first bore are all in direct fluid connection when hydraulic pressure within said first passage reaches a predetermined amount and said first passage, said second passage and said second bore are all in direct fluid connection when hydraulic pressure within said second passage reaches a predetermined amount.

8. The housing as in claim 7 wherein said at least one other passage receives a shaft.

9. The housing as in claim 7 wherein said housing is for a two-pressure zone gerotor motor.

10. The housing as in claim 7 wherein said at least one valve includes a first valve positioned within a bore in fluid communication with said first passage.

11. The housing as in claim 10 wherein said at least one valve includes a second valve positioned within a bore in fluid communication with said second passage.

* * * * *